US006782889B2

(12) United States Patent
Ducci et al.

(10) Patent No.: US 6,782,889 B2
(45) Date of Patent: Aug. 31, 2004

(54) APPARATUS FOR MANIPULATING TOWS OF FILAMENTARY MATERIAL

(75) Inventors: Andreas Ducci, Escheburg (DE); Wolfgang Steiniger, Geesthacht (DE); Peter Schumacher, Elmshorn (DE); Harald Nittscher, Hamburg (DE); Clemens Schmick, Geesthacht (DE)

(73) Assignee: Hauni Maschinenbau AG, Hamburg (DE)

( * ) Notice: Subject to any disclaimer, the term of this patent is extended or adjusted under 35 U.S.C. 154(b) by 0 days.

(21) Appl. No.: 10/190,686

(22) Filed: Jul. 9, 2002

(65) Prior Publication Data

US 2003/0010347 A1 Jan. 16, 2003

(30) Foreign Application Priority Data

Jul. 10, 2001 (DE) ..... 101 32 760

(51) Int. Cl.[7] ..... A24C 5/18
(52) U.S. Cl. ..... 131/84.1; 131/84.4
(58) Field of Search ..... 131/84.1, 84.3, 131/84.4, 110, 83.1; 198/716, 832, 836.1

(56) References Cited

U.S. PATENT DOCUMENTS

| | | | | | |
|---|---|---|---|---|---|
| 3,987,804 | A | * | 10/1976 | Molins et al. | 131/84.3 |
| 4,793,634 | A | * | 12/1988 | Alloggiamento | 283/2 |
| 4,883,076 | A | | 11/1989 | Belvederi | |
| 5,135,008 | A | | 8/1992 | Oesterling et al. | |
| 5,398,703 | A | * | 3/1995 | Belvederi et al. | 131/84.1 |
| 5,526,826 | A | * | 6/1996 | Heitmann | 131/84.4 |
| 5,813,412 | A | * | 9/1998 | Okumoto | 131/84.4 |
| 6,360,751 | B1 | * | 3/2002 | Fagg et al. | 131/84.4 |
| 2001/0019011 | A1 | * | 9/2001 | Schmick et al. | 198/832 |

FOREIGN PATENT DOCUMENTS

| | | | | |
|---|---|---|---|---|
| DE | 38 37 201 A1 | | 5/1989 | |
| DE | 42 15 059 A1 | | 11/1993 | |
| DE | 43 33 046 A1 | | 3/1995 | |
| GB | 919150 | * | 2/1963 | A24C/5/18 |
| WO | 99/05924 | * | 2/1999 | A24C/5/18 |

OTHER PUBLICATIONS

Research Disclosure, Sep. 1989, No. 305.
Research Disclosure, Mar. 1990, No. 311.

* cited by examiner

*Primary Examiner*—Steven P. Griffin
*Assistant Examiner*—Carlos Lopez
(74) *Attorney, Agent, or Firm*—Venable LLP; Robert Kinberg

(57) ABSTRACT

Apparatus for controlled removal of surplus material from one or more tows of tobacco particles, filter material for tobacco smoke or the like employs at least one belt conveyor for each stream. The outer side of such belt conveyor is provided with recesses which receive particulate material at the stream forming station or stations. Each stream is equalized by a discrete trimming device which employs a pair of cooperating rotary knives having circular cutting edges and serving to remove the surplus prior to compacting and wrapping of the thus obtained rod-like filler or fillers into web(s) of cigarette paper of the like. The material which has entered the recesses of the belt conveyor(s) contributes to greater density of the corresponding portions of the fillers or fillers, and such densified portions are severed by a cutoff to be located at the ends of plain cigarettes or at the tobacco-containing ends of filter cigarettes.

23 Claims, 7 Drawing Sheets

APPARATUS FOR MANIPULATING TOWS OF FILAMENTARY MATERIAL

CROSS-REFERENCE TO RELATED CASES

The present application claims the priority of the commonly owned copending German patent application Serial No. 101 32 760.9 filed Jul. 10, 2001. The disclosure of the aforementioned priority application, as well as that of each U.S. and foreign patent, patent application and publication identified in the specification of the present application, is incorporated herein by reference.

BACKGROUND OF THE INVENTION

The present invention relates to improvements in apparatus for treating fibrous materials of the tobacco processing industry, and more particularly to apparatus for treating surplus-containing streams or flows (such as tows) of filamentary material (such as tobacco shreds, filaments of filter material for tobacco smoke and the like) prior to final processing, e.g., prior to wrapping into webs of cigarette paper or prior to subdivision into stream sections of desired length.

An apparatus for treating one or more streams of fibrous material for use in the tobacco processing industry (e.g., one or more streams of shredded tobacco leaf laminae), for example, for the making of plain cigarettes or filter cigarettes, normally comprises a conveyor for each surplus-containing stream and an equalizing means which includes a discrete surplus removing device for each stream. Each conveyor defines a channel or path for the respective stream and, if the apparatus comprises several conveyors, the channels defined by such conveyors are or can be parallel to each other.

Apparatus of the above outlined character are disclosed in commonly owned U.S. Pat. No. 5,526,826 and in the corresponding German patent No. 43 33 046 A1.

The patented apparatus comprises a surplus removing device having a pair of knives and a deflector for removed fragments of fibrous material. The deflector is provided (a) with a peripheral surface which directs the removed fibrous material away from the trimming knives and (b) with a circular knife at that end of the peripheral surface which is adjacent the trimming knives.

A somewhat similar surplus removing arrangement is disclosed (at 30546) in the September 1989 issue (No. 305) of the RESEARCH DISCLOSURE published by Emsworth Design, Inc. now located at 200 Park Avenue, New York, N.Y. 10003. This surplus removing arrangement employs two surplus removing devices each of which is set up to remove the surplus from the respective one of two discrete tobacco streams. The streams are parallel to each other and one of the two surplus removing devices is located downstream of the other (as seen in the direction of flow of fibrous material along its respective path). The means for deflecting freshly removed fibrous material from the trimming knives of each surplus removing device comprises a rotary brush.

OBJECT OF THE INVENTION

An object of the invention is to provide an apparatus for treating one or more surplus-containing streams which constitutes an improvement over and a further development of the aforediscussed conventional apparatus.

SUMMARY OF THE INVENTION

The invention is embodied in an apparatus for treating at least one surplus-containing stream of fibrous material of the tobacco processing industry prior to further processing of the stream. Such further processing can include wrapping the treated stream into a web of cigarette paper or the like to form a continuous tobacco-containing rod, subdividing the rod into sections of unit length or multiple unit length, packing the thus obtained rod-shaped smokers' products, and connecting the sections with filter mouthpieces to obtain filter cigarettes, cigars or cigarillos prior to packing.

The improved apparatus comprises material advancing means including at least one conveyor defining an elongated channel for advancement of the at least one stream in a predetermined direction, along a predetermined path and at, a predetermined speed. The at least one conveyor includes at least one sidewall and means for moving the at least one sidewall in the predetermined direction and at least close to the predetermined speed. The at least one sidewall includes a stream-contacting surface provided with spaced-apart recesses for portions of the at least one stream, and the apparatus further comprises equalizing means including means for removing the surplus from the advancing stream downstream of the sidewall, as seen in the predetermined direction.

The at least one sidewall can form part of an endless flexible element, e.g., a belt, particularly a toothed belt.

The at least one conveyor can include a plurality of sidewalls, and the means for moving the sidewalls can include means for advancing each of the sidewalls in the predetermined direction and at least close to the predetermined speed. Each sidewall includes a stream-contacting surface. The at least one conveyor can include two sidewalls, and the means for moving can include means for synchronizing the movements of the sidewalls with each other. Each of the stream-contacting surfaces can be provided with spaced-apart recesses for portions of the at least one stream.

The improved apparatus preferably further comprises means for subdividing the equalized stream into a series of discrete sections (e.g., into plain cigarettes of unit length or multiple unit length) and means for synchronizing the operation of the subdividing means with the operation of the moving means. The synchronizing means can include signal generating means which monitors the portions of the at least one stream in the predetermined path.

If the improved apparatus is designed to treat a plurality of surplus-containing streams of fibrous material (such as tobacco or filter material for tobacco smoke), the advancing means includes a plurality of conveyors (one for each of the plurality of streams), and the equalizing means includes a discrete surplus removing means for each of the plurality of conveyors.

The single surplus removing means or each surplus removing means can include a pair of rotary trimming knives having circular severing portions adjacent each other at the single channel or at the respective channel, means for rotating the knives in opposite directions, and means for deflecting the removed material from the knives. The severing portions of the knives are disposed in a plane which is located at a predetermined distance from the at least one conveyor or from the respective conveyor. The severing portions of the knives of each surplus removing means are adjacent to the central portion of the single channel or the respective channel.

The knives of the single surplus removing means or of each surplus removing means are disposed between the single channel or the respective channel and the single deflecting means or the respective deflecting means. The single deflecting means or each deflecting means (depending upon the number of surplus removing means) can comprise a substantially frustoconical rotary deflector for the removed surplus of fibrous material. The peripheral surface of each deflector can include a first portion which is adjacent the knives of the single surplus removing means (or the respective surplus removing means), a second portion which is remote from the knives, and an intermediate portion between the first and second portions. As already mentioned hereinbefore, the knives of the single surplus removing means or of each surplus removing means are or can be disposed in a common plane; the first portion of the peripheral surface of the deflector or each deflector makes with the common plane of the associated knives a relatively small acute angle (e.g., an angle of about 5°), and the second portion of such peripheral surface makes with the plane a larger angle (e.g., an acute angle of, for example, 40°, a right angle or an obtuse angle, e.g., an angle of about 120°). The intermediate portion of the frustoconical surface preferably establishes a gradual transition between the first and second portions of such surface.

The diameter of one trimming knife can exceed the diameter of the other trimming knife of the single surplus removing means or each surplus removing means. Alternatively, the trimming knives of each surplus removing means can have at least substantially identical diameters.

If the improved apparatus is designed to treat at least two at least substantially parallel surplus-containing streams of fibrous material, the material advancing means includes a discrete conveyor for each of the at least two streams and the channels which are defined by the conveyors are spaced apart a predetermined distance from each other. The equalizing means of such apparatus comprises a discrete surplus removing means for each other the streams, and at least one such surplus removing means can include a plurality of rotary trimming knives including a first knife and a second knife disposed between the channels and having a diameter which at most equals the predetermined distance. The knives are or can be round, and the diameter of each second knife can at least approximate the predetermined distance. The knives are preferably provided with smooth (such as non-recessed) peripheral surfaces (cutting edges).

The apparatus can further comprise a novel housing for at least a portion of at least one of the material advancing means and the equalizing means. A presently preferred housing includes at least one extruded section which can consist of or can contain aluminum. The housing is preferably convertible for use with one or more conveyors, and the at least one section can constitute a distancing element which is adapted to be put to use in the housing irrespective of the number of conveyors.

The novel features which are considered as characteristic of the invention are set forth in particular in the appended claims. The improved apparatus itself, however, both as to its construction and the modes of assembling and operating the same, together with numerous additional important and advantageous features and attributes thereof, will be best understood upon perusal of the following detailed description of certain presently preferred specific embodiments with reference to the accompanying drawing.

DESCRIPTION OF PREFERRED EMBODIMENTS

Figure 1:
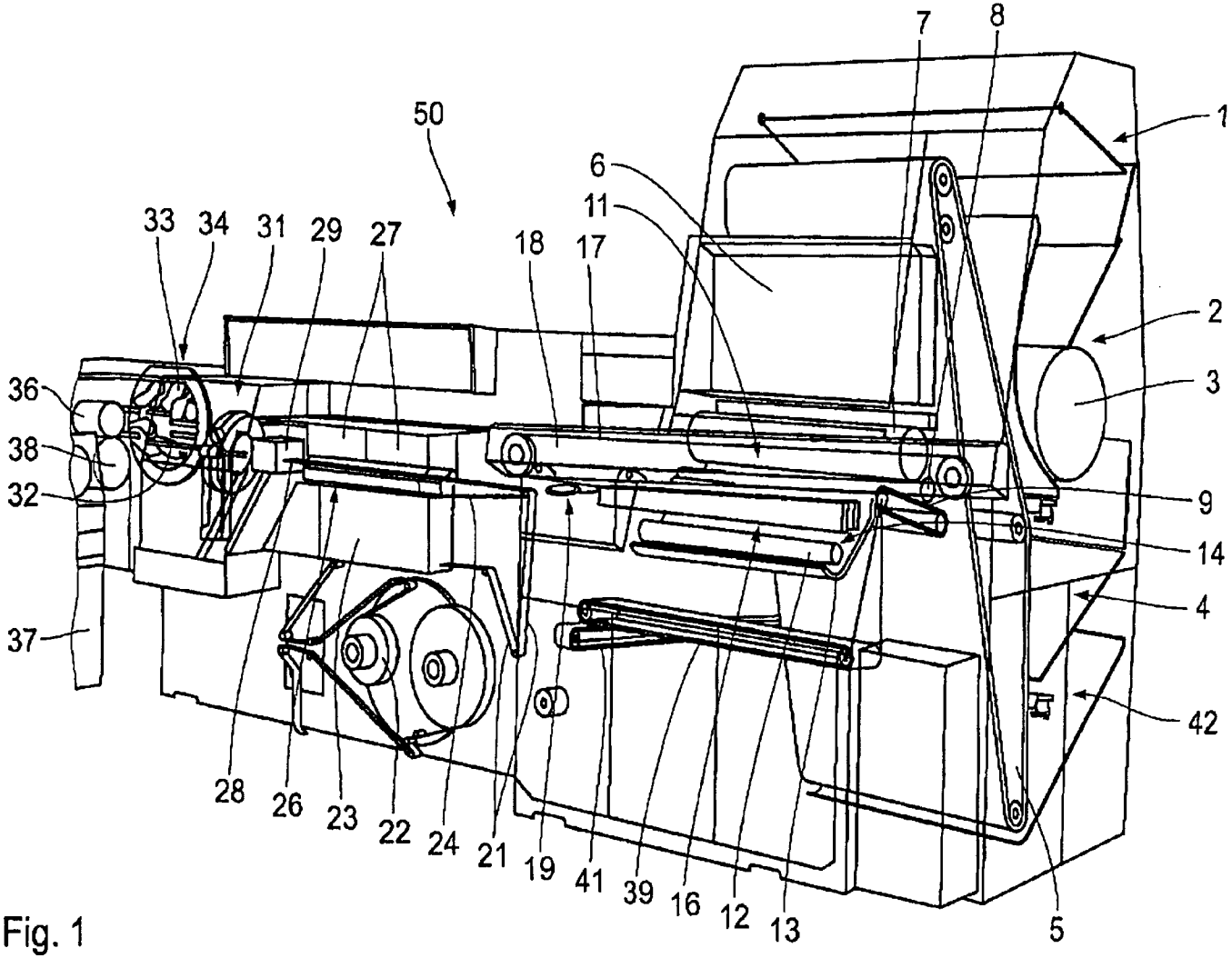
FIG. 1 is a perspective view of a machine for the making of a single file of plain cigarettes or analogous rod-shaped smokers' products which are fed to a filter tipping machine.

The cigarette making machine 50 of FIG. 1 comprises a hopper having a gate 1 which supplies batches of tobacco particles (such as shredded tobacco leaves) to a distributor 2. A rotary drum-shaped withdrawing conveyor 3 serves to deliver (when necessary) tobacco particles from the distributor 2 into a magazine 4 which cooperates with an endless elevator conveyor 5 serving to supply metered quantities of tobacco particles into an at least substantially upright gathering duct 6. A carded rotary cylinder 7 draws tobacco particles from the lower end of the duct 6 and a picker roller 8 propels the particles at a constant rate from the carding of the cylinder 7 onto an endless apron 9 which is driven at a constant speed. Successive increments of the layer of tobacco particles which gathers on the apron 9 are propelled against a sifting device 11 wherein a curtain of streamlets of air permits the less desirable heavier particles (such as fragments of tobacco ribs, eyes and the like) to pass but deflects the more satisfactory lightweight particles into a funnel 14 including a driven carded drum 12 and a stationary wall 13. The drum 12 propels satisfactory tobacco particles into a novel tobacco guiding channel 16 and against an endless foraminous belt conveyor 17 adjacent a suction chamber 18 which attracts the thus obtained stream or tow of tobacco particles to the conveyor 17 to produce a continuous tobacco stream 52 (see FIG. 2) which contains a surplus of tobacco particles, namely more than necessary or desired in the filler of a continuous cigarette rod. A detailed description and illustration of a cigarette rod making machine employing several of the aforedescribed parts including the conveyor 17 can be found in commonly owned German patent No. 42 15 059.

Figure 2:
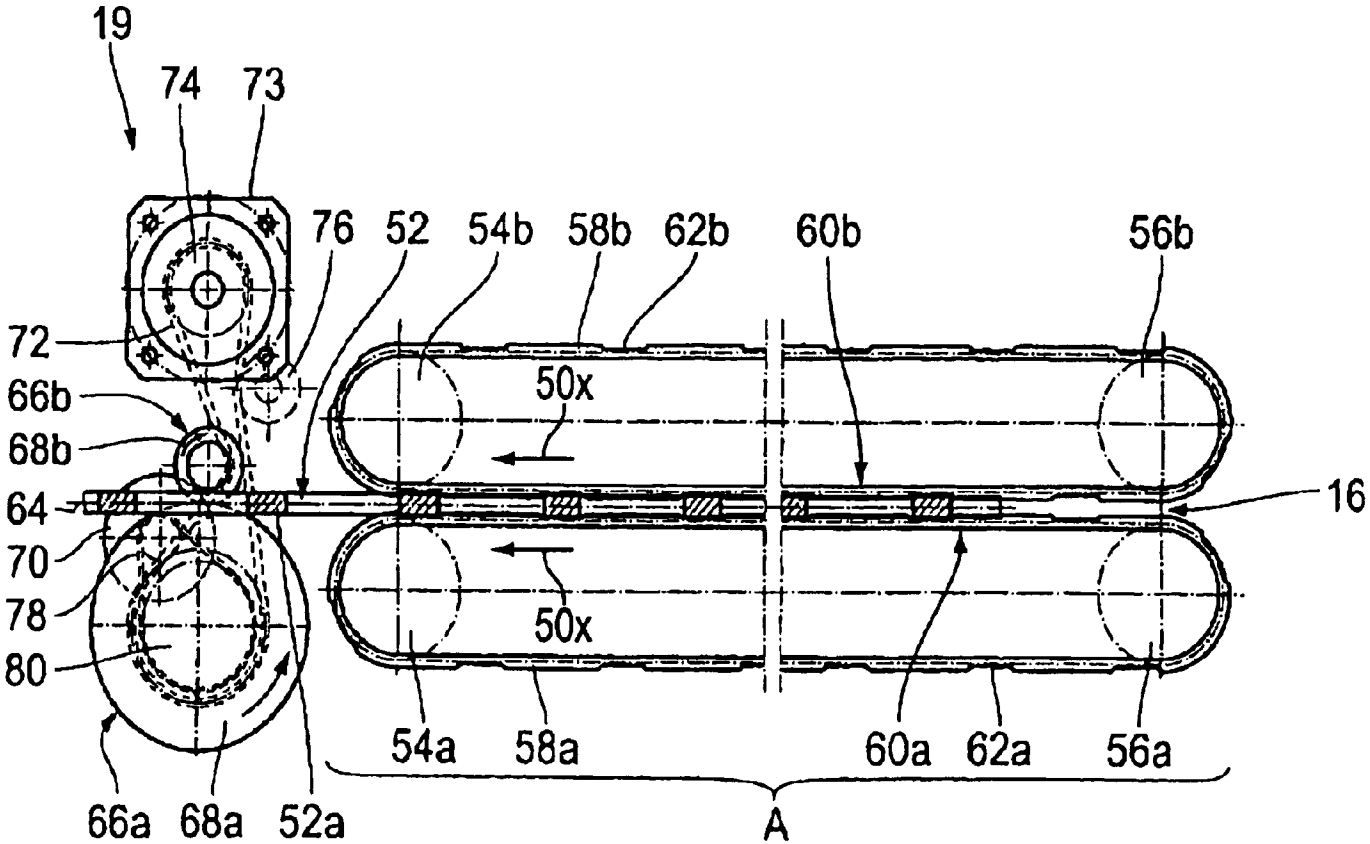
FIG. 2 is an enlarged fragmentary plan view of that portion of the plain cigarette making machine of FIG. 1 which embodies one form of the improved apparatus designed to treat a single surplus-containing stream of tobacco particles.

The conveyor 17 delivers successive increments of the fully grown (surplus-containing) tobacco stream 52 into the range of a preferably adjustable equalizing means including a single trimming or surplus removing device 19 one embodiment of which is illustrated in greater detail in FIG. 2. A modified trimming device is shown (at 319) in FIG. 6.

Referring again to FIG. 1, the equalized tobacco stream 52 which moves beyond the trimming or equalizing device 19 advances lengthwise onto a cigarette paper web 21 which is drawn off a bobbin or reel 22 and is moved by an endless belt conveyor 24 (called garniture) through an imprinting mechanism 23 and into a wrapping unit 26. The latter drapes the web 21 around the trimmed tobacco stream 52 arriving from the foraminous conveyor 17 in such a way that one longitudinal marginal portion of the web overlies the other longitudinal marginal portion subsequent to the application or activation of a film of a suitable adhesive (e.g., a hotmelt) to one such marginal portion. The wrapping mechanism 26 comprises a tandem sealer 27 for the seam of the thus obtained tubular wrapper of the continuous cigarette rod 28 which leaves the mechanism 26 and advances through a suitable standard density monitoring device 29 (this monitoring device controls the operation of the trimming device 19) on its way into the range of a cutoff 31 which severs the cigarette rod 28 at regular intervals to convert it into a succession of plain cigarettes 32 of unit length or multiple unit length (depending upon whether the plain cigarettes 32 are fed directly into a packing machine or into a filter cigarette making machine).

FIG. 1 shows a transfer unit 34 having automatically controlled arms 33 which transfer successive plain cigarettes 32 (assumed to be of double unit length) onto a drum-shaped conveyor 36 of a filter cigarette making (tipping) machine 37 having a rotary drum-shaped cutter 38 which divides each cigarette 32 into two plain cigarettes of unit length. A suitable filter cigarette making machine is disclosed in commonly owned U.S. Pat. No. 5,135,008 to Oesterling et al. Such machines are known as MAX.

FIG. 1 further shows two belt or band conveyors 39, 41 which serve to transport removed surplus tobacco from the trimming device 19 into a receptacle 42 which is adjacent and supplies tobacco particles to the pockets of the elevator conveyor 5. The receptacle 42 forms part of the hopper which includes the aforediscussed magazine 4 and the distributor 2.

Referring to FIG. 2, the structure shown therein constitutes one embodiment of a tobacco manipulating apparatus which forms part of the cigarette making machine 50 of FIG. 1 and is designed to treat the single stream 52 of satisfactory tobacco particles (i.e., those which have been intercepted by the tobacco curtain 11 and those drawn from the receptacle 42) prior to further processing by the trimming device 19, in the wrapping mechanism 26, by the cutoff 31, by the transfer unit 34, by the filter tipping machine 37, and so forth. The channel 16 for the tobacco stream 52 is disposed between two endless toothed conveyor belts 58*a*, 58*b* which are or can be mirror images of each other with reference to a plane 64 that is normal to the plane of FIG. 2 and halves the channel 16. The foraminous belt conveyor 17 is installed in the machine 50 at a level above the plane of FIG. 2 and supplies satisfactory tobacco particles into the channel 16 wherein the stream 52 is caused to advance in a direction from the right to the left (see the arrows 50*x*), i.e., toward and into the range of the single trimming or equalizing device or unit 19 of the equalizing means which removes the surplus and causes the removed smokable material to reach one of the conveyors 39, 41 for delivery by the other of these conveyors into the receptacle 42 adjacent the path of ascending paddles or pockets or analogous entraining elements of the endless elevator conveyor 5.

The toothed belt 58*a* is trained over pulleys 54*a*, 56*a* each of which can constitute a gear and at least one of which (e.g., the pulley 56*a*) is driven by a suitable prime mover, not shown, and the toothed belt 58*b* is trained over toothed gears or pulleys 54*b*, 56*b* at least one of which (e.g., the pulley 56*b*) is driven, e.g., by the prime mover which drives one of the pulleys 54*a*, 56*a*. The two neighboring stretches or reaches 60*a*, 60*b* of the belts 58*a*, 58*b* define the channel 16 along an elongated path A which ends at least slightly ahead (upstream) of the trimming device 19. The speeds of the belts 58*a*, 58*b* match that of the conveyor 17, i.e., those elongated stretches or reaches (60*a*, 60*b*) of the belts 58*a*, 58*b* which contact the tobacco stream 52 in the channel 16 move at the speed at which the conveyor 17 advances relative to the suction chamber 18 which is installed between the upper and lower reaches of the conveyor 17. Reference may be had, for example, to FIG. 1 of the commonly owned U.S. Pat. No. 5,526,826 to Heitmann.

The outer sides of the belt conveyors 58*a*, 58*b* Are provided with sets of preferably equidistant longitudinally spaced apart recesses or pockets 62*a*, 62*b* for reception of tobacco particles which together constitute longitudinally extending projections or protuberances 52*a* of the tobacco stream 52. Such projections (and the tobacco stream portions between them) contain tobacco which is compacted to an extent greater than the tobacco between successive longitudinally spaced apart projections. Each recess 62*a* of the belt conveyor 58*a* in the apparatus which is shown in FIG. 2 confronts a recess 62*b* in the belt conveyor 58*b* while such pairs of recesses advance in the channel 16.

It will be seen that the stretches 60*a*, 60*b* of the toothed belt conveyors 58*a*, 58*b* constitute two elongated sidewalls which flank the channel 16 and the portion of the elongated tobacco stream 52 therein. The projections 52*a* are at least substantially depressed into the main body of the tobacco stream 52 not later than in the wrapping mechanism 26 of the cigarette making machine 50 so that the diameter of each plain cigarette 32 is at least substantially constant from end to end but selected portions (particularly the free ends of the tobacco-containing parts of all filter cigarettes turned out by the filter tipping machine 37) are less likely to lose tobacco particles during packing in a packing machine and/or during opening of a pack and/or during removal from the pack and/or during other manipulation by the smoker (i.e., prior to lighting of the free end).

The trimming device 19 of FIGS. 1 and 2 is or can be closely adjacent to the outlet of the channel 16 and is designed to remove surplus tobacco from all those portions of the running stream 52 which contain a surplus, i.e., not only from the portions which include the enlarged portions or projections 52*a*. This trimming device comprises two smooth circular disc-shapped trimming knives 68*a*, 68*b* respectively having narrow peripheral surfaces (cutting edges) 66*a*, 66*b* which are immediately adjacent to and contact each other at a preselected distance from the conveyor 17 in a plane 64 which coincides with the aforementioned central plane halving the channel 16 between the stretches 60*a*, 60*b* of the two endless belt conveyors 58*a*, 58*b*. The prime mover 74 of the trimming device 19 is set up to rotate the knives 68*a*, 68*b* in opposite directions (as indicated by the arrows).

The trimming device 19 further comprises a rotary frustoconical refuser or deflector 70 which directs the removed surplus tobacco particles away from the trimming station and is located at those sides of the endless belt conveyors 58*a*, 58*b* which face away from the foraminous conveyor 17. The prime mover 74 is installed in a housing 73 and is arranged to rotate the knives 68*a*, 68*b* as well as the deflector 70. The transmission between the rotary output element of the prime mover 74 (e.g., a variable-speed electric motor) and the parts 68*a*, 68*b*, 70 includes at least one driven endless belt, chain or band 72 which is tensioned by a spring-biased roll 76. The deflector 70 is driven by the prime mover 74 through the medium of a further endless belt, chain or band 78 which receives motion from the shaft 80 of the knife 78*a* and drives a pulley or gear on the shaft of the part 70. The diameter of the peripheral surface (cutting edge) 66*a* is or approximates about three times the diameter of the peripheral surface (cutting edge) 66*b*.

An important advantage of the apparatus including the belt conveyors 58*a*, 58*b* and the trimming device 19 is that the tobacco stream is provided with enlarged portions 52*a* during making in the channel 16 and that the enlarged portions 52*a* are invariably of identical or predictable size and shape as well as that they are located at optimum distances from each other, i.e., for predictable severing by the cutoff 31 so that each filter cigarette turned out by the tipping machine 37 has a densified tobacco-containing end.

Densification of longitudinally spaced-apart portions of a continuous tobacco-containing rod is already known in the art. Reference may be had, for example, to published German patent application Serial No. 38 37 201 A1 and to the corresponding U.S. Pat. No. 4,883,076 to Belvederi. These publications disclose an apparatus wherein trimming discs of the surplus removing or equalizing means are provided with recesses and are coplanar with the advancing tobacco stream. The recesses in the trimming discs provide room for the accumulation of tobacco particles so that the corresponding portions of the stream contain more tobacco which is to contribute to greater density of the corresponding portions of the finished tobacco rod. A drawback of the patented machine is that the recesses in the trimming discs cause such discs to exert undesirable additional forces upon the surplus-containing tobacco stream, namely forces which influence the weights of the finished products, i.e., the weights of plain or filter cigarettes turned out by a machine corresponding to that embodying the structure disclosed in U.S. Pat. No. 4,883,076 are likely or bound to depart from each other and/or from a predetermined weight. The machine shown in FIGS. 1 and 2 of the present application avoids such undesirable variations of weight by increasing the quantities of tobacco particles in preselected portions of an advancing tobacco stream ahead of the trimming or equalizing station. Furthermore, the novel trimming or equalizing device 19 can employ trimming knives (68*a*, 68*b*) having circular (i.e., non-recessed) peripheral surfaces (66*a*, 66*b*).

Another advantage of the improved apparatus is that the toothed and recessed belt conveyors 58*a*, 58*b* render it possible to turn out a tobacco stream (52) with enlarged portions or projections 52*a* which are much more uniform than those produced by the recessed trimming discs of the machine disclosed in U.S. Pat. No. 4,883,076. The reason is that the stretches or reaches 60*a*, 60*b* of the belt conveyors 58*a*, 58*b* can remain in much longer contact with the tobacco stream 52 in the channel 16 than a tobacco stream which advances through the nip of a pair of trimming discs used in a trimming device of the type shown in U.S. Pat. No. 4,883,076. Otherwise stated, the apparatus of the present invention employs means (58*a*, 58*b*) which provide the tobacco stream 52 with enlarged portions or projections 52*a* while in relatively long-lasting contact with the tobacco stream; on the other hand, the apparatus which is disclosed in the U.S. Pat. No. 4,883,076 employs trimming knives which are to provide the tobacco stream with enlarged or densified portions while in extremely short-lasting contact with the tobacco stream.

The just discussed advantages of the improved apparatus exist also when the novel apparatus is compared with that disclosed (at 31138) in the March 1990 issue (No. 311) of the aforementioned RESEARCH DISCLOSURE. This publication discloses an apparatus which employs rotary compacting means serving to perform the compacting functions of the trimming discs employed in the apparatus disclosed in U.S. Pat. No. 4,883,076.

The toothed belt conveyors 58*a*, 58*b* of the apparatus shown in FIG. 2 exhibit the additional advantage that they can be readily driven at a desired speed by resorting to simple moving means (such as the toothed pulleys or gears 56*a*, 56*b*). It often suffices to employ a single recessed belt (58*a* or 58*b*).

The apparatus of FIG. 2 can employ a belt conveyor (58*a* or 58*b*) which is devoid of recesses (62*a* or 62*b*) and merely moves with the other of these belt conveyors to ensure that the two conveyors can define the channel 16, i.e., a path for the advancement of a tobacco stream deviating from the stream 52 in that it includes enlarged portions formed solely by tobacco particles which have penetrated into the recesses 62*a* or 62*b*. Still further, it is possible to combine the belt conveyor 58*a* or 58*b* with a belt conveyor (replacing the belt conveyor 58*b* or 58*a*) which is not only devoid of recesses but is also stationary so that the tobacco stream slides therealong. The exact configurations of the belt conveyors and whether or not both are driven or only one thereof is driven will depend on the desired sizes, shapes and distributions of the enlarged portions 52*a* or of modifications of such enlarged portions.

Figure 3:
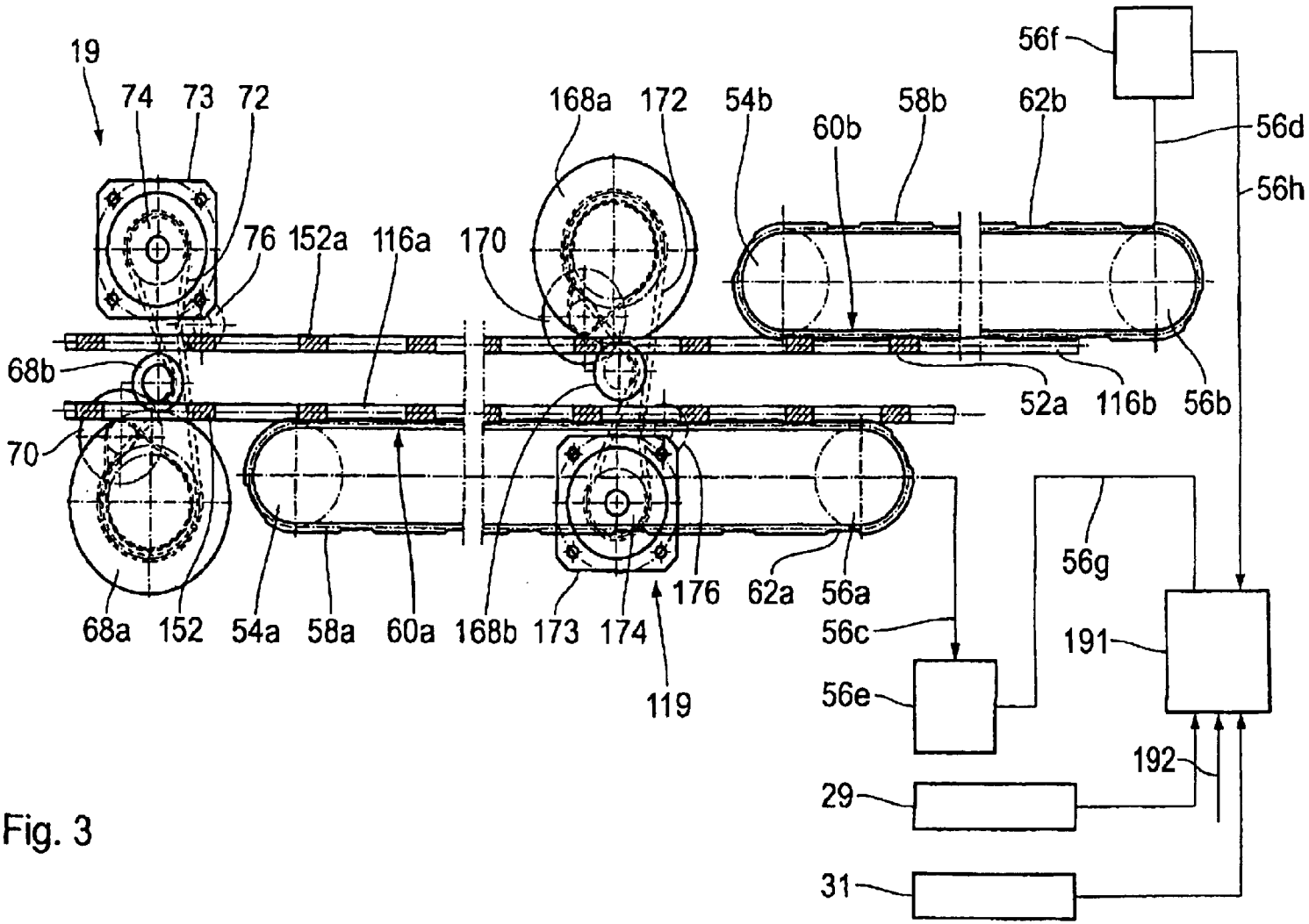
FIG. 3 is a similar fragmentary plan view of a portion of a modified plain cigarette making machine with an apparatus which is designed to turn out and to remove surplus from a plurality of at least substantially parallel tobacco streams.

FIG. 3 illustrates certain novel features and certain additional details of a cigarette making machine which can turn out two continuous tobacco streams 116*a*, 116*b*. All such parts of the (second) apparatus in the machine of FIG. 3 which are identical with the parts of the apparatus of FIGS. 1–2 are denoted by identical reference characters and will be described only to the extent which is necessary for full understanding of the construction and mode of operation of the second apparatus. Those parts of the second apparatus which are analogous to (and/or functional equivalents of) the parts of the apparatus shown in FIGS. 1–2 are denoted by similar reference characters plus 100.

The tobacco stream 116*a* is provided with enlarged portions or projections 152 which are formed by the toothed belt conveyor 58*a*, and the tobacco stream 116*b* is provided with projections 152*a* formed by the toothed belt conveyor 58*b*. Thus, the projections 152 are not or need not be identical with the projections 152*a* each of which is formed between two belts 58*a*, 58*b* respectively having recesses 62*a*, 62*b*. The recesses 62*a*, 62*b* of the respective belt conveyors 58*a*, 58*b* shown in FIG. 3 are but need not be identical with the recesses 62*a*, 62*b* of the belt conveyors 58*a*, 58*b* shown in FIG. 2.

The pulleys 56*a*, 56*b* for the belt conveyors 58*a*, 58*b* of FIG. 3 have shafts 56*c*, 56*d* which are respectively driven by suitable prime movers 56*e*, 56*f*, e.g., by variable-speed electric motors. The speeds of the prime movers 56*e*, 56*f* are regulated by a control unit 191, preferably in such a way that the making of the projections 152*a* in the stream 116*a* is synchronized with that of the projections 152*a* in the stream 116*b*. The characters 56*g*, 56*h* denote conductor means which respectively connect the control unit 191 with the prime movers 56*e*, 56*f*. The control unit 191 further receives signals from the density monitoring device 29 which can be designed to ascertain the density of the stream 116*a* independently of the stream 116*b* and vice versa. The exact construction of the monitoring devices 29 which are utilized in the apparatus of FIGS. 1–2 and 3 forms no part of the present invention.

The control unit 191 can influence the operations of the prime movers 56*e*, 56*f* for the driven pulleys or gears 56*a*, 56*b* in such a way that the cutoffs 31 (only one shown in FIG. 3) for the converted (wrapped) streams 116*a*, 116*b* sever the respective cigarette rods (not shown in FIG. 3)

across successive enlarged portions 152*a*. The reasons for such severing of the two cigarette rods turned out by the dual machine of FIG. 3 are the same as those already explained with reference to FIGS. 1 and 2, i.e., tobacco particles are less likely to escape from the (densified) free ends of tobacco-containing portions of filter cigarettes which receive plain cigarettes from the machine embodying the apparatus of FIG. 3.

It goes without saying that the cigarette making machine 50 of FIG. 1 can also employ a control unit corresponding to the control unit 191 of FIG. 3 and serving to synchronize the operation of the driven pulley 56*a* of FIG. 2 with that of the pulley 56*b* of FIG. 2.

The trimming device 19 of FIG. 3 serves to remove surplus tobacco from the stream 116*a*, and a similar or identical trimming device 119 is provided to remove the surplus from the tobacco stream 116*b* downstream of the conveyor 58*b*. The parts of the trimming device 119 are turned through 180° with reference to the corresponding parts of the trimming device 19. For example, the trimming knife 68*a* is adjacent to and is located in front of the front pulley 54*a* for the belt conveyor 58*a*, and the trimming knife 168*a* is adjacent and is located in front of the front pulley 54*b* for the belt conveyor 58*b*. Thus, the knives 68*a*, 168*a* are disposed at opposite sides of a plane which is normal to the plane of FIG. 3 and is located midway between the paths for the tobacco streams 116*a*, 116*b*. The diameters of the smaller trimming knives 68*b*, 168*b* match or closely approximate the distance between the paths for the tobacco streams 116*a* and 116*b*. The trimming devices 19, 119 together constitute a composite equalizing means for the tobacco streams 116*a*, 116*b* in the apparatus of FIG. 3.

An important advantage of the control unit 191 is that it can synchronize the movement of the belt conveyor 58*a* with that of the belt conveyor 58*b* by the simple expedient of controlling the rotary movements of the pulleys or gears 56*a* and 56*b*. These pulleys cooperate with the respective pulleys 54*a*, 54*b* to ensure that the stream-containing stretches or reaches 60*a* and 60*b* are at optimum levels relative to the respective streams or flows 116*a*, 116*b*. Furthermore, the control unit 191 can carry out the additional function of synchronizing the operation of each of the trimming devices 19, 119 as well as the operations of the cutoffs 31 for the respective cigarette rods 28 with the speeds of the respective belt conveyors 58*a*, 58*b* to ensure that the rods 28 are severed across successive densified portions, i.e., across those portions of the wrapped tobacco streams 116*a*, 116*b* which contain larger quantities of tobacco particles than the neighboring portions of the tobacco streams due to the presence of tobacco particles which were caused to enter the recesses 62*a*, 62*b* prior to densification, trimming and wrapping of the tobacco tows or streams. All this contributes to higher quality of the ultimate products, be it filter cigarettes, cigars or cigarillos turned out by the tipping machine or machines 37 or equivalent tipping machines, or plain cigarettes, cigars or cigarillos turned out by a modification of the structure shown in FIG. 1, namely by a structure which supplies plain cigarettes 32 (or plain cigars or plain cigarillos) directly to a packing machine. The just enumerated advantages of the control unit 191 can be achieved irrespective of whether the improved apparatus is set up to make a single tow of smokable or tobacco smoke influencing material or two or even more tows.

The frequency at which the cutoff or cutoffs severs or sever one or more wrapped tows of tobacco particles or other particulate material of the tobacco processing industry can be monitored by any suitable sensor or sensors, and the thus obtained signals are transmitted into and further processed by the control unit 191. FIG. 3 shows conductor means 192 which can transmit signals from the sensor or sensors serving to monitor the frequency of operation of one or more cutoffs 31.

Each trimming or equalizing device (such as each of the devices 19, 119) can employ a refuser or deflector (70, 170) which constitutes or resembles the frustum of a cone and is arranged to rotate about an axis which is at least substantially normal to the direction of forward movement (see the arrows 50*x* in FIG. 2) of the surplus-containing stream or streams 52 or 116*a*, 116*b*. Furthermore, the axis of rotation of each deflector is preferably parallel to the axes of rotation of the associated circular trimming discs (such as the trimming discs 68*a*, 68*b* of the trimming device 19 shown in FIG. 2 or the trimming discs 68*a*, 68*b* and 168*a*, 168*b* of the devices 19, 119 shown in FIG. 3). As already mentioned hereinbefore, a presently preferred deflector (e.g., the deflector 70 shown in FIG. 2) has a frustoconical peripheral surface which makes a relatively small acute angle (such as an angle of about 5°) with the common plane of the trimming discs 68*a*, 68*b* and a larger acute angle (e.g., an angle of about 40°) with a plane which is parallel to the common plane of the discs 68*a*, 68*b* but is located at the other axial end of the deflector. The conicity of the peripheral surface of the deflector 70 increases gradually from 5° to 40°; this ensures highly predictable and highly satisfactory deflection of removed surplus from the knives 68*a* and 68*b*. However, it is equally within the scope of the present invention to employ a deflector with a frustoconical external surface which makes with the common plane of the disc-shaped trimming knives an angle of up to 90° and even of up to 120°, i.e., an obtuse angle. Such larger angles contribute to gentler tratment of fibrous material which the deflector is to direct away from the trimming station.

The aforediscussed selection of the diameters of trimming discs in the trimming devices 19 and 119 has been found to be of advantage in a machine which turns out several parallel tobacco streams because such trimming devices occupy a surprisingly small amount of space which is invariably or at least frequently at a premium in machines employing apparatus of the type shown in FIG. 3.

Figure 4:
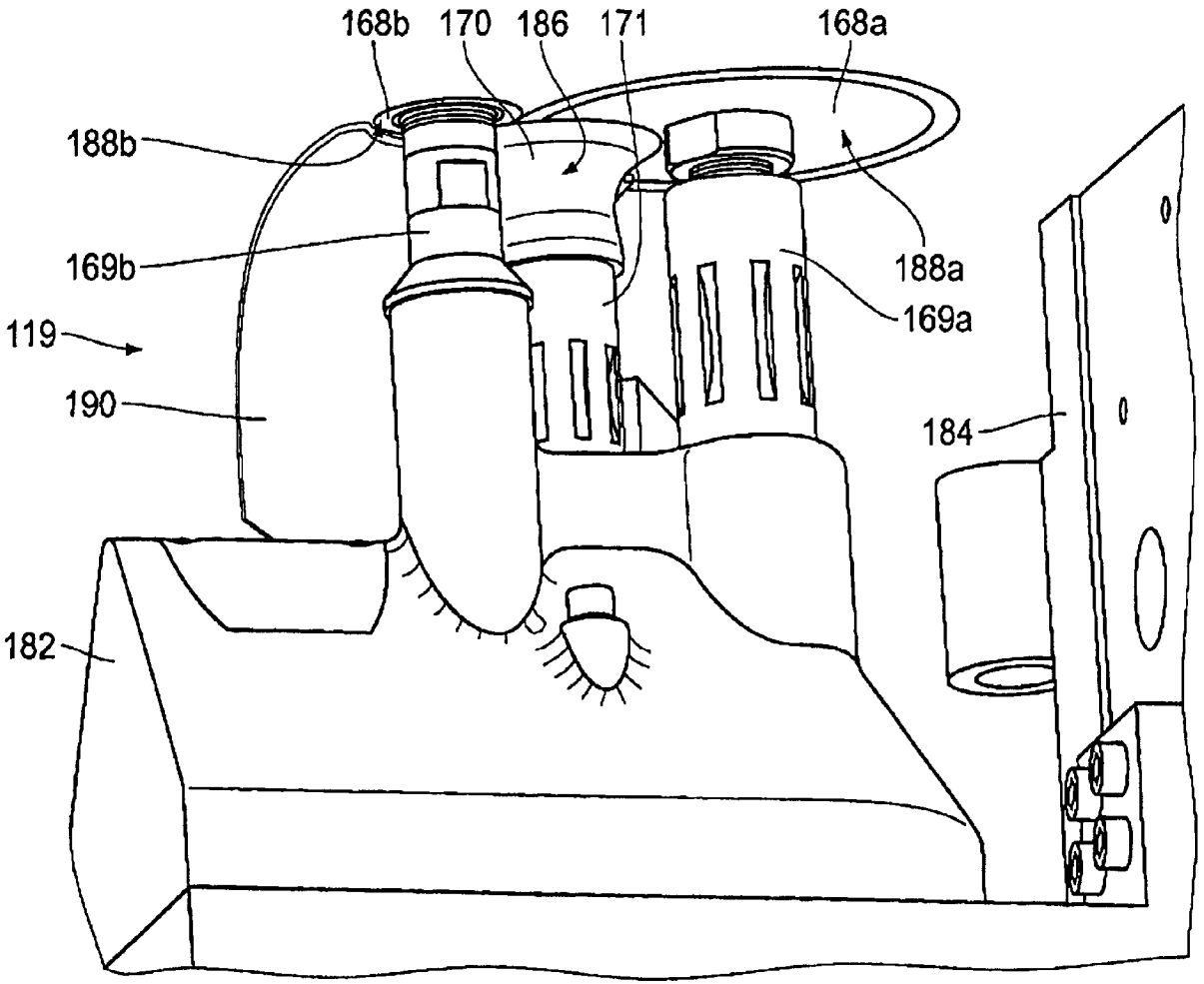
FIG. 4 is an enlarged fragmentary perspective view of one surplus removing arrangement in the equalizing means of that embodiment of the improved apparatus which is illustrated in FIG. 3.

FIG. 4 is a perspective view of the trimming device 119 which is utilized in the apparatus of FIG. 3. The shafts (not shown) for the disc-shaped trimming knives 168*a*, 168*b* and the rotary deflector or refuser 170 are respectively journalled in the housings 169*a*, 169*b* and 171. These housings are mounted on a casing 182 which, in turn, is carried by the housing 184 of the cigarette rod making machine embodying the structure shown in FIG. 4.

The surfaces 188*a*, 188*b* of the trimming knives 168*a*, 168*b* are coplanar or immediately adjacent each other. Such surfaces make small acute angles (e.g., 5°) with the adjacent end portion of the frustoconical peripheral tobacco deflecting surface 186 of the deflector 170. That end portion of the surface 186 which is more distant from the trimming knives 168*a*, 168*b* makes a larger acute angle (e.g., 40°) with the common plane of the knives 168*a*, 168*b*, and the intermediate portion of the surface 186 constitutes a preferably gradual transition between the two end portions. The deflector 170 is located upstream (ahead) of a plate-like deflector 190 which directs removed tobacco particles from the deflector 170 toward suitable conveyor means (such as the endless conveyors 39, 41 shown in FIG. 1).

Figure 5:
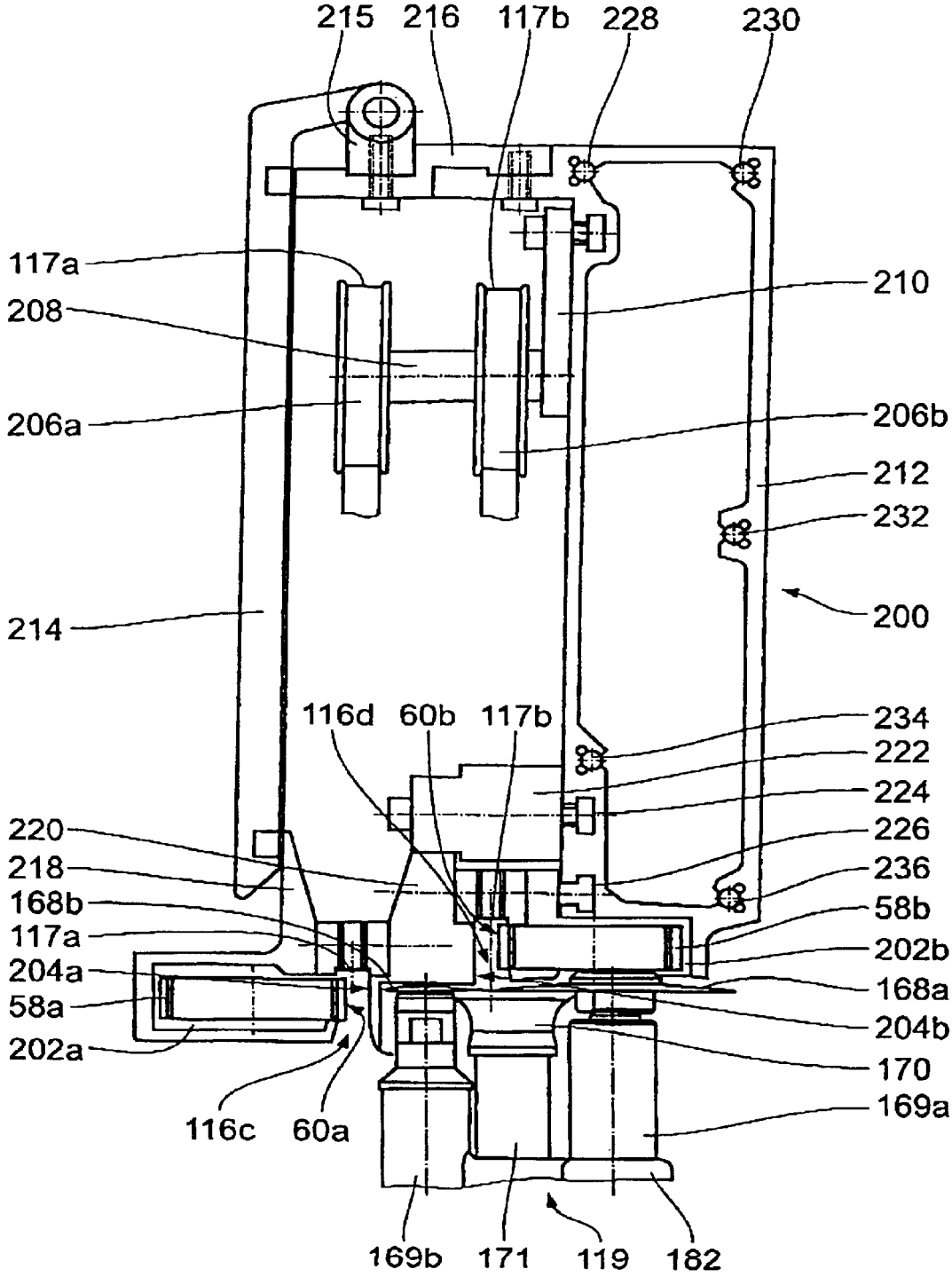
FIG. 5 is a different partly sectional view of a portion of an apparatus of the type illustrated in FIG. 3.

FIG. 5 shows a portion of an apparatus which is analogous to that of FIGS. 3 and 4 but with one (19) of the trimming devices 19, 119 omitted. Those parts of the apparatus of FIG. 5 which are identical with or plainly analogous to the corresponding parts of the apparatus of FIGS. 3–4 are denoted by identical reference characters; the parts not shown in or plainly different from those shown in FIG. 1 are denoted by reference characters 200 and higher.

The character 200 denotes a composite housing which confines two tobacco channels 116*c*, 116*d*. These channels are disposed below two foraminous belt conveyors 117*a*, 117*b* which deliver thereto tobacco particles for the making of the tobacco streams, not shown in FIG. 5. The sidewalls for the tobacco channels 116*c*, 116*d* are constituted by the stretches 60*a*, 60*b* of toothed belt conveyors 58*a*, 58*b* respectively installed in the portions 202*a*, 202*b* of the housing 200. The tobacco channels 116*c*, 116*d* are further bounded by (inner) walls or cheeks 204*a*, 204*b* which are affixed to the housing 200. The belt conveyors 117*a*, 117*b* are trained over deflecting pulleys or rollers 206*a*, 206*b* mounted on a shaft 208 which is supported by the housing 200 through the medium of a plate-like member 210.

The housing 200 comprises several components or sections. The right-hand section 212 of this housing is an extruded part which defines a chamber, and the left-hand section 214 is L-shaped and preferably also constitutes an extrusion. The housing 200 further comprises an extrusion 215 which serves as a connector for the section 214, and a set of distancing elements 216, 218 and 220 which connect the sections 212, 214 to each other and each of which also constitutes an extrusion. The illustrated housing 200 is assumed to consist of aluminum.

The section 216 is utilized only in the housing 200 of a cigarette making machine embodying an apparatus of the type shown in FIGS. 3 to 5 and 7, namely an apparatus which can turn out simultaneously a plurality of streams of tobacco, filter material for tobacco smoke or other fibrous material of the tobacco processing industry. This section 216 enables the housing 200 to provide room for at least one additional tobacco stream, such as 116*d*. The sections 212, 214, 215, 218 and 220 can be assembled into a modified housing which can accommodate a machine 50 of the type shown in FIGS. 1 and 2.

If the sections 212, 214, 215, 218, 220 are to be utilized to assemble a housing for a machine which turns out two tobacco streams, the section 220 is connected with the section 212 by a coupling member 222 and a socket or receptacle 224 of the section 212.

If the sections 212, 214, 215, 218, 220 are to be utilized in a housing for a machine 50 which turns out a single tobacco stream, the section 218 is connected with the section 212 by way of a second socket or receptacle 226 but without using the section 220 and coupling member 222.

An advantage of the housing 200 is its versatility, i.e., it can be assembled for use with a machine 50 or with a machine which turns out simultaneously more than a single stream of fibrous material. If it is to be utilized with the machine 50, a front part of the section 212 is provided with integrated receiving means or receptacles 228, 230, 232, 234 and 236 which are designed to facilitate the connection to the machine 50.

Figure 6:
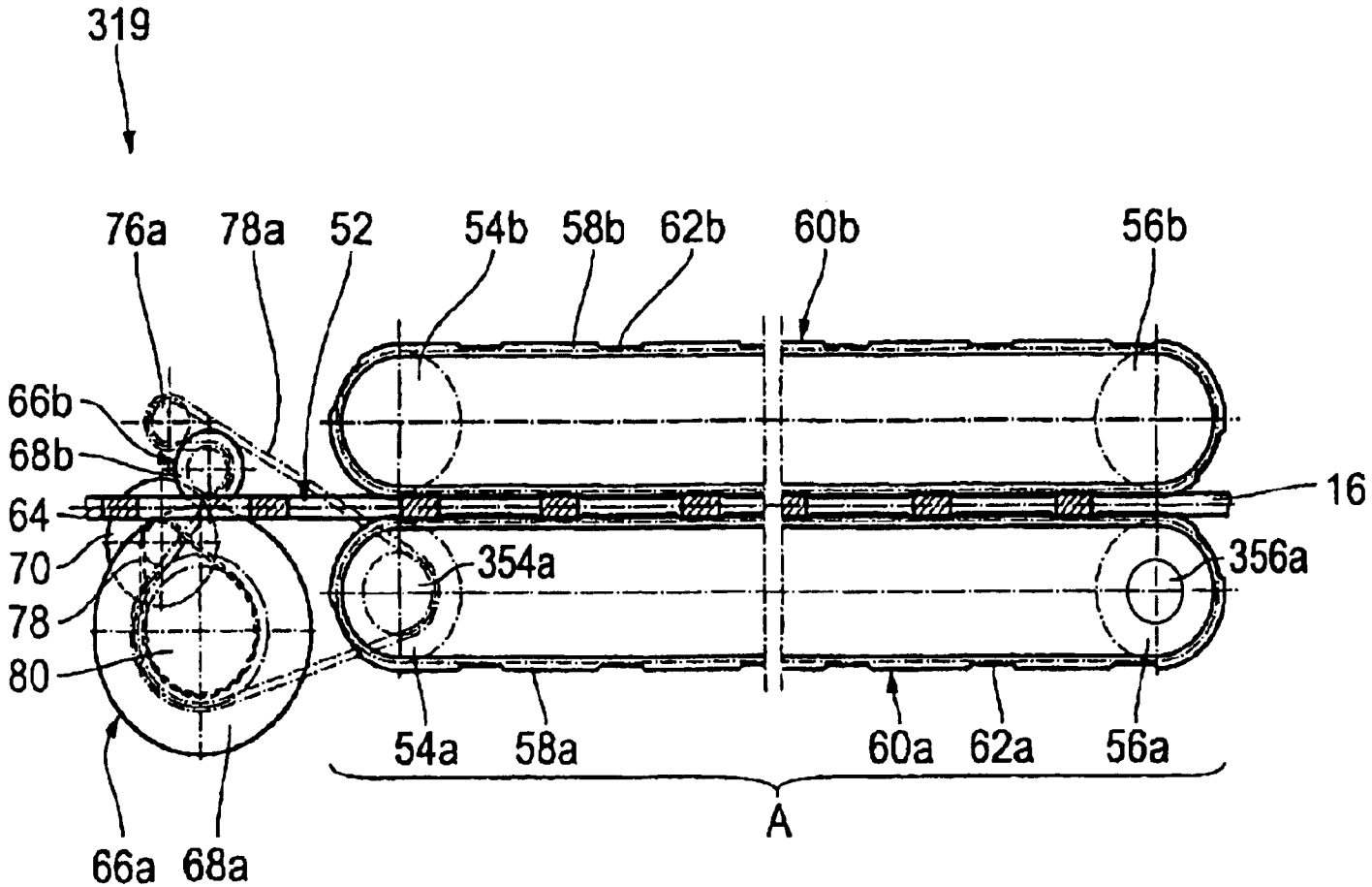
FIG. 6 is a schematic plan view of a third apparatus which constitutes a modification of the apparatus illustrated in FIG. 2, primarily in that it employs a different surplus removing device arranged to receive motion from a prime mover for the tobacco stream advancing conveyor.

The sections and other parts of the frame or housing 200 can be provided with tapped bores or holes for threaded fasteners which are employed for the assembly of sections into a housing for a machine 50 of the type shown in FIGS. 1, 2 and 6 or for a machine embodying the structure shown in FIGS. 3–5 and 7. Such design contributes to the versatility of the housing 200 and to lower cost of the entire machine. An advantage of a housing wherein at least some of the sections are extrusions made of aluminum is that the weight and cost of the housing and of the machine employing the housing are much lower than those of conventional housings and machines.

FIG. 6 is a schematic plan view of a further embodiment of the present invention which constitutes a modification of that shown in FIGS. 1 and 2. Its mode of operation is similar to that of the structure shown in FIG. 2 and will not be described again. The main difference between the embodiments of FIGS. 2 and 6 is that the latter employs a modified trimming or equalizing device 319.

The shaft 354*a* for the pulley 54*a* for the belt conveyor 58*a* forms part of or receives motion from a prime mover (e.g., a variable-speed electric motor) which further serves to drive the trimming knives 68*a*, 68*b* and the deflector 70. Alternatively, the shaft 356*a* of the pulley for the belt conveyor 58*a* drives the pulley 54*a* by way of the belt conveyor 58*a*, and the shaft 354*a* of the thus driven pulley 54*a* transmits torque to the rotary parts of the trimming device 319. The transmission between the shaft 354*a* and the parts 68*a*, 68*b*, 70 comprises an endless belt, band or chain 78*a* which is trained over a pulley or gear on the shaft 354*a* and over pulleys or gears on the shafts of the parts 68*a*, 68*b* and on the shaft of a tensioning roll 76*a*. The deflector 70 is driven by a further endless flexible element 78 which receives motion from the shaft 80 of the trimming knife 68*a*.

Figure 7:
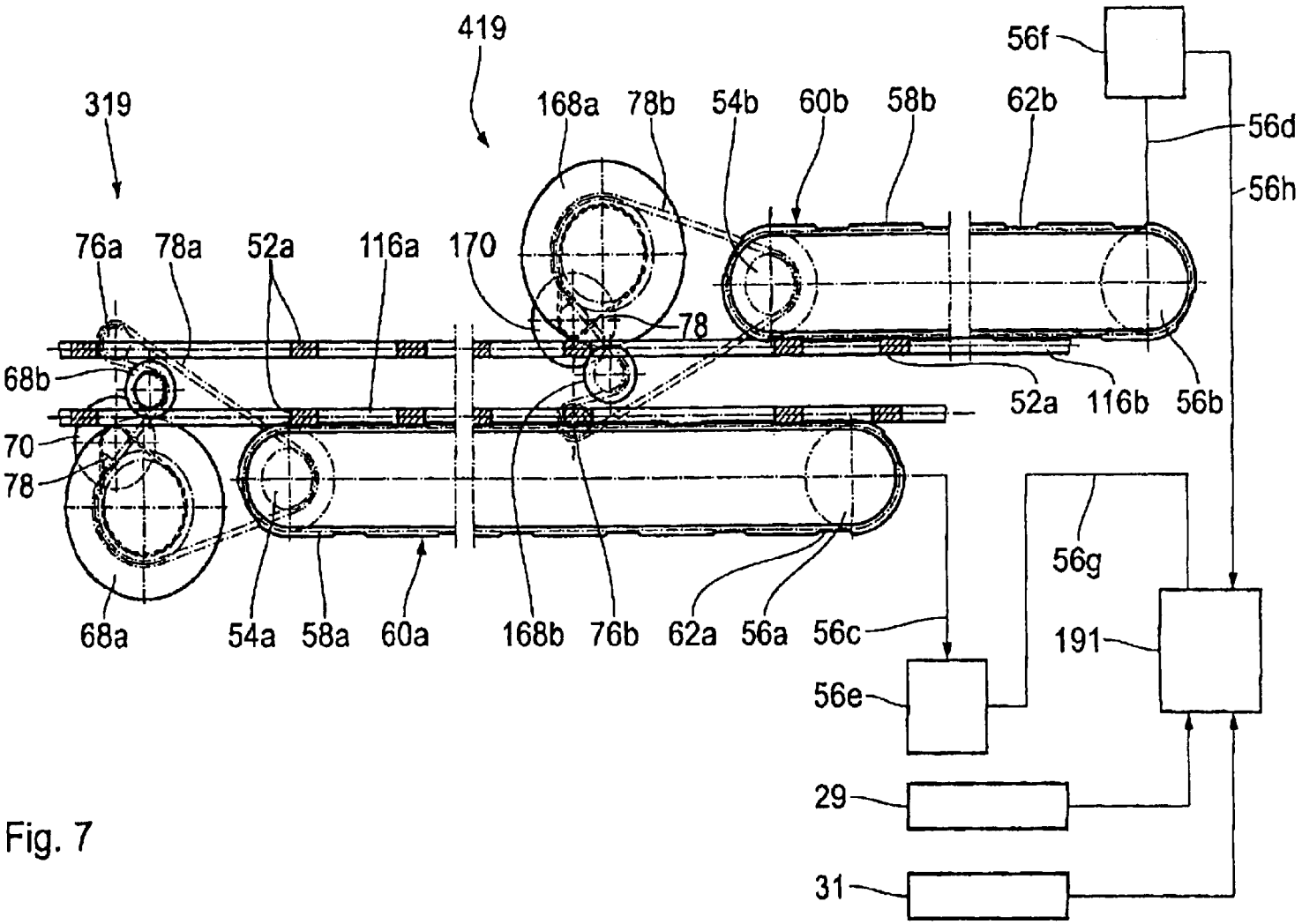
FIG. 7 is a view similar to that of FIG. 3 but showing two surplus removing devices of the type shown in FIG. 6.

FIG. 7 illustrates a machine of the type shown in FIG. 3 but with a trimming or equalizing device 319 for the tobacco stream 116*a* and a similar trimming or equalizing device 419 for the tobacco stream 116*b*. In all other respects, the machine of FIG. 7 is or can be identical with the machine of FIG. 3; this also applies for the modes of operation of these machines. The parts 76*b*, 78*b* of the trimming device 419 correspond to the parts 76*a*, 78*a* of the trimming device 319, and the tensioning roll 76*b* is a functional equivalent of the tensioning roll 76*a*.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of apparatus for manipulating tows and analogous accumulations of filamentary material and therefore, such adaptations should and are intended to be comprehended within the meaning and range of equivalence of the appended claims.

What is claimed is:

1. Apparatus for treating at least one surplus-containing stream of fibrous material of the tobacco processing industry prior to further processing, comprising:

material advancing means including at least one conveyor defining an elongated channel for advancement of the at least one stream in a predetermined direction along a predetermined path and at a predetermined speed, said at least one conveyor including a plurality of sidewalls and means for moving said plurality of sidewall in said direction and at least close to said predetermined speed, said plurality of sidewalls each including a stream-contacting surface, at least one of the stream-contacting surfaces being provided with spaced-apart recesses for portions of the at least one stream, wherein said means for moving includes means for advancing each of said sidewalls in said direction and at least close to said predetermined speed and further includes means for synchronizing the movements of said sidewalls with each other; and equalizing means including means for removing the surplus from the advancing stream downstream of said sidewalls as seen in said direction.

2. The apparatus of claim 1, wherein said plurality of sidewalls form part of an endless flexible element.

3. The apparatus of claim 2, wherein said endless flexible element includes a belt.

4. The apparatus of claim 2, wherein said endless flexible element forms part of a toothed belt.

5. The apparatus of claim 1, wherein said at least one conveyor includes two sidewalls.

6. The apparatus of claim 1, wherein each of said stream-contacting surfaces is provided with spaced-apart recesses for portions of the at least one stream.

7. The apparatus of claim 1, further comprising means for subdividing the equalized stream into a series of discrete sections and means for synchronizing the operation of said subdividing means with that of said moving means.

8. The apparatus of claim 7, wherein said operation synchronizing means includes signal generating means for monitoring the portions of the at least one stream in said predetermined path.

9. The apparatus of claim 1 for treating at least two at least substantially parallel surplus-containing streams of fibrous material, wherein said material advancing means includes a discrete conveyor for each of said at least two streams, the channels defined by said conveyors being spaced apart a predetermined distance from each other and said equalizing means comprising a discrete surplus removing means for each of said streams, at least one of said surplus removing means including a pair of rotary trimming knives including a first knife and a second knife disposed between said channels and having a diameter at most equal to said predetermined distance.

10. The apparatus of claim 9, wherein said knives are round and the diameter of said second knife at least approximates said predetermined distance, said knives having smooth peripheral surfaces.

11. The apparatus of claim 1, further comprising a housing for at least a portion of at least one of said material advancing and said equalizing means, said housing including at least one extruded section.

12. The apparatus of claim 11, wherein said at least one section contains aluminum.

13. The apparatus of claim 11, wherein said housing is convertible for use with one or more conveyors and said at least one section constitutes a distancing element which is adapted to be put to use in said housing irrespective of the number of conveyors.

14. The apparatus for treating a plurality of surplus-containing streams of fibrous material of the tobacco processing industry prior to further processing, comprising:

material advancing means including, a plurality of conveyors, one for each of said plurality of streams, wherein each conveyor defines an elongated channel for advancement of the respective stream in a predetermined direction along a predetermined path and at a predetermined speed and includes at least one sidewall and means for moving said at least one sidewall in said direction and at least close to said predetermined speed, said at least one sidewall including a stream-contacting surface provided with spaced-apart recesses for portions of the respective stream; and equalizing means including means for removing the surplus from the advancing stream downstream of said at least one sidewall as seen in said direction, said equalizing means including a discrete surplus removing means for each of said plurality of conveyors.

15. Apparatus for treating at least one surplus-containing stream of fibrous material of the tobacco processing industry prior to further processing, comprising:

material advancing means including at least one conveyor defining an elongated channel for advancement of the at least one stream in a predetermined direction along a predetermined path and at a predetermined speed, said at least one conveyor including at least one sidewall and means for moving said at least one sidewall in said direction and at least close to said predetermined speed, said at least one sidewall including a stream-contacting surface provided with spaced-apart recesses for portions of the at least one stream; and equalizing means including means for removing the surplus from the advancing stream downstream of said sidewall as seen in said direction, wherein said surplus removing means includes a pair of rotary trimming knives having annular severing portions adjacent each other at said channel, means for rotating said knives in opposite directions, and means for deflecting the removed material from said knives.

16. The apparatus of claim 15, wherein said severing portions of said knives are disposed in a plane at a predetermined distance from said at least one conveyor and said channel has a central portion, said severing portions being adjacent each other at said central portion of said channel.

17. The apparatus of claim 15, wherein said knives are disposed between said channel and said deflecting means.

18. The apparatus of claim 15, wherein said deflecting means comprises a substantially frustoconical rotary deflector for removed surplus of fibrous material.

19. The apparatus of claim 18, wherein said deflector has a peripheral surface including a first portion adjacent said knives, a second portion remote from said knives, and an intermediate portion between said first and second portions.

20. The apparatus of claim 19, wherein said knives are disposed in a common plane, said first portion of said peripheral surface makes with said plane an angle of about 5° and said second portion of said peripheral surface makes with said plane an angle of about 40°.

21. The apparatus of claim 19, wherein said intermediate portion provides a gradual transition between said first and second portions of the peripheral surface of said deflector.

22. The apparatus of claim 15, wherein said trimming knives are round and the diameter of one of said knives exceeds the diameter of the other of said knives.

23. The apparatus of claim 15, wherein said trimming knives are round and have at least substantially identical diameters.

* * * * *